United States Patent [19]

Katz

[11] Patent Number: 4,867,450

[45] Date of Patent: Sep. 19, 1989

[54] TENNIS TRAINING BALL AND METHOD OF USE THEREOF

[76] Inventor: Danny Katz, 60 Sutton Pl. South, New York, N.Y. 10022

[21] Appl. No.: 114,829

[22] Filed: Oct. 30, 1987

[51] Int. Cl.[4] ..... A63B 61/00

[52] U.S. Cl. ..... 273/29 A; 273/26 R; 273/58 R; 273/61 R; 273/61 A

[58] Field of Search ..... 273/58 R, 61 R, 60 R, 273/26 B, 61 A, 61 B, 61 C, 61 D, 29 A

[56] References Cited

U.S. PATENT DOCUMENTS

| | | | |
|---|---|---|---|
| 401 | 4/1888 | Peck et al. | 273/61 R |
| 1,161,846 | 9/1915 | Clausen | 273/58 R |
| 3,117,384 | 1/1964 | Billis | 273/58 R |
| 3,904,201 | 9/1975 | Henry | 273/61 R |
| 4,170,352 | 10/1979 | Veala | 273/61 R |

*Primary Examiner*—T. Brown

[57] ABSTRACT

The invention relates to a tennis training ball and a method of its use. The surface of the ball is covered with markings of alphanumeric and/or geometric indicia. The indicia is intentionally made large to the extent that they can be easily distinguished by a player at the instant the ball comes in contact with his racket. During play, a player is required to name a particular pattern of indicia the instant the ball comes in contact with his racket.

6 Claims, 1 Drawing Sheet

TENNIS TRAINING BALL AND METHOD OF USE THEREOF

BACKGROUND OF THE INVENTION

1. Field of the Invention

The invention relates to a tennis training ball, and more particularly to a tennis ball having a surface covering which is marked with alphanumeric and/or geometric patterns which assist in training a tennis player to properly hit the ball. The invention also relates to a method of training a tennis player by using such a training ball.

2. Description of the Related Art

In training a novice tennis player it is important to develop habitual concentration on the position of the ball in relation to his tennis racquet at the instant the ball comes in contact with the racquet. This enables the player to develop a swing such that the ball will be positioned at the so-called "sweet spot" of maximum racket impact. The normal tendency is for the player's eye to follow the ball itself, without regard to where it is in relation to his racquet upon contact with the ball, the racquet being treated virtually as an extension of his arm and so meriting little attention once it has begun to swing forward.

U.S. Pat. No. 4,170,352, issued Oct. 9, 1979, discloses a tennis training ball having a surface covering comprising a pair of interlocking figure eight patterns in contrasting colors, thereby highlighting the rotation of the ball during flight so the player can perceive the kind of spin which has been imparted to it. However, this does not address the problem of training the player to habitually concentrate on the location of the ball in relation to the racquet upon impact therewith.

SUMMARY OF THE INVENTION

The invention provides a tennis training ball having a surface covering comprising a plurality of clearly visually distinguishable and monosyllabically named discrete patterns marked in separate locations thereon. Such patterns may be numerical digits, geometrical shapes, or letters of the alphabet, and are preferably in contrasting colors. No more than six patterns should be employed. For use in tennis training, the player verbally calls out the monosyllabic name of the pattern he perceived at the instant his racquet came in contact with a ball ejected from a ball throwing machine. Since the teacher can also perceive such pattern, guessing would quickly become obvious to the teacher. The player is therefore compelled to concentrate on the ball at the instant of contact. Repetition of such training process makes such concentration habitual, whereby it persists even when the player hits standard tennis balls.

DESCRIPTION OF THE PREFERRED EMBODIMENTS

Figure 1:
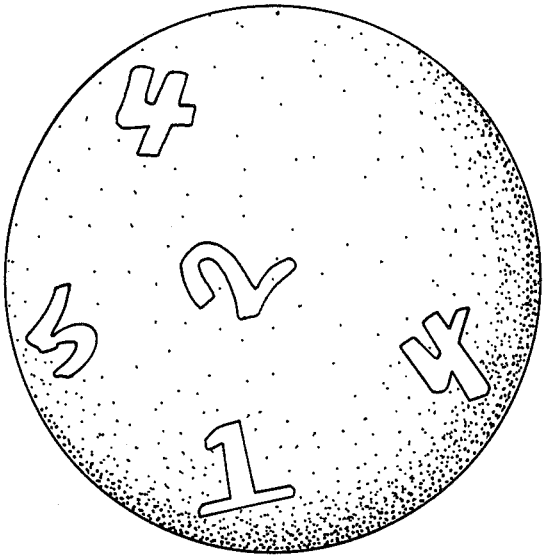
FIG. 1 shows a tennis training ball which, in accordance with invention, has a surface covering comprising six decimal digits having monosyllabic names which are clearly visually distinguishable at separate locations thereon.

Referring to FIG. 1, the illustrated tennis training ball has a surface covering comprising a few clearly visually distinguishable and monosyllabically named discrete patterns thereon in the form of the decimal digits 1,2, 4 and 5. Any one of such digits,such as 4, may be more than one location. Such digits are preferably at least about $2\frac{1}{2}$ inches high and $\frac{1}{2}$ to $\frac{3}{4}$ inch thick, so as to be clearly visually distinguishable. The digits "zero" and "seven" are avoided, since these are bi-syllabic names and so require more time for the player to verbally identify to the teacher. This is important because successive balls will be delivered to the player in rapid succession, for return by volleying prior to hitting the court surface. The spacing and number of patterns should be such that at least one pattern is clearly visible to the player at any orientation of the ball with respect to the "sweet spot" of his tennis racquet at the moment of impact. Applicant has found, for that purpose, that at least four patterns are necessary. To avoid overcrowding, which would reduce the ability to distinguish individual patterns, not more than six patterns should be included. These should be approximately equidistant from each other.

Figure 2:
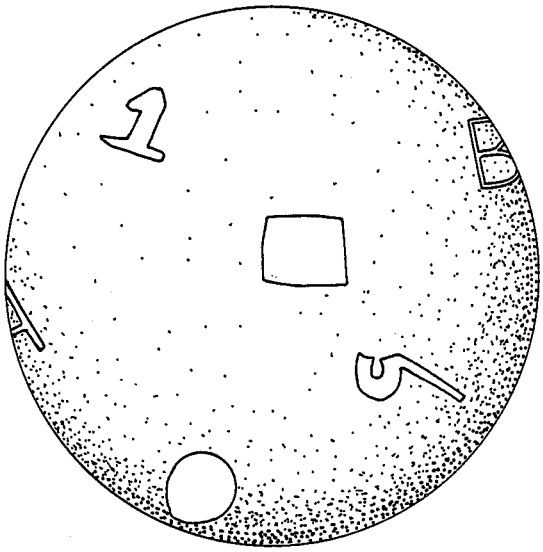
FIG. 2 shows a tennis training ball which, in accordance with the invention, has a surface covering comprising a plurality of decimal digits, letters of the alphabet and geometric shapes, such as circles and squares having monosyllabic names and which are clearly visually distinguishable at separate locations thereon.

FIG. 2 shows a tennis training ball having a surface covering comprising a plurality of clearly visually distinguishable and monosyllabically named discrete patterns thereon in the form of decimal digits, letters of the alphabet and geometric shapes, for example a circle and a square. A triangle is to be avoided, because it is a trisyllabic name requiring excessive time to verbally identify. Of course, several circles and/or squares can be employed at different locations on the surface covering of the ball. Circles are preferably about $1\frac{1}{2}$ inch in diameter, and squares about $1\frac{1}{2}$ inch on each side. Alphabetic letters should be of the same height and width as numerical digits.

In order to further distinguish and permit instant visual perception of the individual discrete patterns, it is preferable to provide them in several colors, such as red, blue or the like, arranged so that adjacent patterns are of contrasting color.

The patterns on a ball may be or include monosyllabic letters of the English alphabet such as the letters A or B shown in FIG. 2, with either or both of the numerical and geometrical patterns. Although the alphabetic letters in FIG. 2 are in English, alphabetic letters of any other alphabet can be used provided such have monosyllabical names in such language. Such letters, as with numbers, should be between about 178 inch to about 1 inch in height. More probably, the height of any alphanumeric or geometric pattern should be in the order of about $\frac{5}{8}$ inch to about $\frac{7}{8}$ inch in order for the average person to be able to immediately recognize same when the ball is hit.

A method for training a tennis player in accordance with the invention comprises directing a plurality of tennis balls to the player in rapid succession, each such ball having a surface covering comprising a plurality of clearly visually distinguishable and monosyllabically named discrete patterns thereon as described above, and having the player verbally name the particular pattern which he perceived at the instant his racquet came in contact with the ball.

While the invention has been described with reference to certain preferred embodiments thereof, it will be obvious to those skilled in the training of tennis players that many variations and modifications thereof may readily be made without departing from the true spirit and scope of the invention as defined in the ensuing claims.

What is claimed is:

1. A tennis training ball having a surface covering comprising a plurality of clearly visually distinguishable and monosyllabically named patterns at discrete locations thereon, said patterns being a plurality of geometric shapes from the group consisting of circles and squares.

2. A tennis training ball in accordance with claim 1, wherein there are at least four and not more than six of said patterns on the surface of said ball.

3. A tennis training ball as claimed in claim 1, wherein said circles are approximately 1½ inch in diameter and said squares are approximately 1½ inch per side thereof.

4. A tennis training ball having a surface covering comprising a plurality of clearly visually distinguishable and monosyllabically named patterns at discrete locations thereon, and said patterns being selected from the group consisting of decimal digits and alphabet letters, and wherein said alphabet letters and decimal digits are at least about ½ to 2½ inches high and between ½ and ¾ inches wide.

5. A tennis training ball in accordance with claim 4, wherein said decimal digits are selected from the group consisting of 1, 2, 3, 4, 5, 6, 8 and 9; and said alphabet letters are selected from the group consisting of A, B, C, D, E, F, G, H, I, J, K, L, M, N, O, P, Q, R, S, T, U, V, W, X, Y, and Z.

6. A method of training a tennis player, comprising directing a plurality of tennis balls in rapid succession to the player to hit with tennis racquet, each of such balls being a tennis training ball having a surface covering comprising a plurality of clearly visually distinguishable and monosyllabically named patterns at discrete locations thereon, and having the player verbally name the particular pattern on the ball with which his racquet comes in contact at the instant of hitting the ball.

* * * * *